US007493720B1

(12) United States Patent
Householder

(10) Patent No.: US 7,493,720 B1
(45) Date of Patent: Feb. 24, 2009

(54) SPENT AMMUNITION CARTRIDGE CASE DEFLECTOR

(76) Inventor: Melvin E. Householder, 8646 Canal Rd. SE., Yelm, WA (US) 98597

( * ) Notice: Subject to any disclaimer, the term of this patent is extended or adjusted under 35 U.S.C. 154(b) by 80 days.

(21) Appl. No.: 11/732,230

(22) Filed: Apr. 2, 2007

(51) Int. Cl.
*F41A 15/00* (2006.01)

(52) U.S. Cl. ..... 42/98; 42/90; 89/33.4

(58) Field of Classification Search ..... 89/33.4; 42/98, 90

See application file for complete search history.

(56) References Cited

U.S. PATENT DOCUMENTS

| | | | | |
|---|---|---|---|---|
| D270,078 | S | 8/1983 | Buffum | |
| 4,691,615 | A | 9/1987 | Brunton | |
| 4,903,426 | A * | 2/1990 | Bammate | 42/98 |
| 5,138,787 | A * | 8/1992 | Riddle et al. | 42/98 |
| 5,285,593 | A * | 2/1994 | Bammate | 42/98 |
| 5,398,439 | A * | 3/1995 | Harless | 42/98 |
| 5,651,208 | A * | 7/1997 | Benson | 42/98 |
| 6,487,808 | B1 | 12/2002 | Carey | |
| 6,530,169 | B1 * | 3/2003 | Griffin | 42/98 |
| 7,168,200 | B2 * | 1/2007 | Perez et al. | 42/98 |

* cited by examiner

*Primary Examiner*—J. Woodrow Eldred
*Assistant Examiner*—Gabriel J Klein
(74) *Attorney, Agent, or Firm*—Brian J. Coyne

(57) ABSTRACT

A safety device for deflecting spent ammunition cartridge cases away from a rifleman as they exit the ejector port of a semiautomatic or automatic rifle. In a first embodiment, intended for use with a rifle from which the carrying handle has been removed from the rifle's upper receiver rail in order to mount a monocular night vision device or other rail-mountable device, the deflector includes a deflector plate pivotably attached to a base plate and movable between a lower, ejector port covering position and an upper, ejector port uncovering position. A thumb-screw adjustable clamp attaches a front end of the base plate to the rail. A rear wall attached to the base plate has a rocker arm mechanism for alternately capturing the deflector plate in the lower position and releasing it to move to the upper position. A second embodiment has two spaced-apart clamps attached to a base plate for attaching the deflector to a rifle's carrying handle, but is otherwise similar to the first embodiment.

19 Claims, 17 Drawing Sheets

SPENT AMMUNITION CARTRIDGE CASE DEFLECTOR

CROSS REFERENCE TO RELATED APPLICATIONS

None

STATEMENT REGARDING FEDERALLY APPROVED RESEARCH OR DEVELOPMENT

None.

BACKGROUND OF THE INVENTION

1. Field of the Invention

This invention relates to the field of firearms, and in particular to devices that deflect spent ammunition cartridge cases away from a rifleman as they are ejected through the ejection port of an automatic or semiautomatic rifle while the rifle is being fired, such rifles including those of the U.S. Army's M4 series. The M4 designation refers to military-style carbines with collapsible buttstocks and shortened barrels. This invention relates further to such devices that, when mounted to a rifle, do not prohibit or obstruct the attachment of a rifle telescope or carrying handle to the rifle, and that can rapidly switch between an extended, cartridge-case-deflecting position and a retracted position.

2. Background Art

Semiautomatic and automatic rifles, including the M4 series of rifles, are generally comprised of an upper receiver, a lower receiver that attaches to a lower portion of the upper receiver, a barrel assembly that attaches to a front portion of the upper receiver, and an ammunition magazine that inserts into a magazine well of the lower receiver. As the rifle is being fired, spent ammunition cartridge cases are ejected through an ejection port, which is usually located on the right side of the upper receiver, in which case the trajectory of the ejected cartridge cases is generally rightwards and rearwards with respect to the rifle and the rifleman who is firing the rifle. Consequently, the hot, spent cartridge cases will occasionally impact the head or shoulders of the rifleman, sometimes causing burns and other injuries. This is especially the case for a left-handed rifleman who, when firing the rifle, places the butt of the rifle against his left shoulder such that the right side of his face is positioned immediately to the rear of the ejection port.

U.S. Pat. No. 6,487,808 to Carey disclosed a combination spent cartridge case deflector and catcher, and breech block actuator for an automatic shotgun. The combination was comprised of a generally planar frame for attachment in vertical orientation to the side of the gun's receiver, and generally parallel therewith, in the area of the ejector port. A lower section of the planar frame supported a removable connection for a spent cartridge case catcher. The spent cartridge case catcher was a generally planar tab with an upper portion that was a generally planar platform oriented substantially perpendicular to the lower portion of the catcher. When the upper portion of the cartridge case catcher was installed on a shotgun, it extended into the ejection port opening, and a resilient plug located on an upper section of the planar frame was disposed generally midway along the length of the ejection port to direct a spent cartridge case downward so that the cartridge case would not fly far away from the user of the gun.

U.S. Pat. No. 4,691,615 to Brunton disclosed a new rifle receiver body for an M-16 rifle that incorporated a deflector portion adapted to divert spent cartridge cases away from the person of the user. The deflector was a boss located at the rear of the ejection port that jutted out from the right side of the rifle body.

The spent ammunition cartridge deflecting devices disclosed by Carey and by Brunton lack the capabilities and features of the present invention, viz: the ability to be mounted to a semiautomatic or automatic rifle without prohibiting or obstructing attachment of a rifle telescope or carrying handle to the rifle, and the ability to rapidly switch between an extended, cartridge-case-deflecting position and a retracted position.

SUMMARY OF THE INVENTION

According to the present invention, a spent ammunition cartridge case deflector is provided for use with a semiautomatic or automatic rifle to protect a rifleman from being burned or otherwise injured by cartridge cases exiting the rifle ejector port while the rifle is being fired. In a first embodiment of the deflector, for use with a rifle from which the carrying handle has been detached so that a monocular night vision device or other device can be mounted on the rifle's upper receiver rail, the deflector comprises a base plate that extends longitudinally from a rear end to a front end; screw-clamp means attached to the base plate for mounting the deflector to the rail; a deflector plate for deflecting spent ammunition cartridge cases downward and away from the rifleman; pivot means attached to the base plate for pivoting the deflector plate between an upper, ejection port uncovering position and a lower, ejection port covering position; and rocker arm catchment and release means attached to the base plate for manually and alternately locking the deflector plate in the lowered position and releasing the deflector plate to pivot upward again to the upper position. The screw clamp means preferably includes a transverse arm having a transverse, threaded bore, a clamp jaw having a transverse bore, and a clamp bolt insertable through the bore of the clamp jaw. The clamp bolt has mating threads for insertion and threaded engagement within the threaded bore of the transverse arm. The rocker arm catchment and release means preferably includes a rear wall that depends from the rear end of the base plate. The rear wall has a bottom edge that joins a left edge to a right edge thereof, a rear surface and an opposite front surface, which rear surface has a rocker arm recess. A rocker arm is pivotally attached to the rear surface of the rear wall adjacent to the rocker arm recess. The rocker arm pivots about a rocker arm pivot pin disposed with the rocker arm recess. The rocker arm extends transversely from a first end to a second end beyond the right edge of the rear wall, which second end includes a catchment spur. The catchment spur has a cam surface. A rocker arm spring is also disposed within the rocker arm recess and urges the first end of the rocker arm away from the rear wall—that is, to an undepressed position. The left edge of the deflector plate aligns with the right edge of the rear wall when the deflector plate is in the lowered position. Pivoting the deflector plate downward from the upper, ejector port uncovering position to the lower, ejector port covering position causes the rear edge of the deflector plate to engage the cam surface of the catchment spur, thereby pivoting the first end of the rocker arm into the rocker arm recess and permitting the rear edge of the deflector plate to engage the right edge of the rear wall, which locks the deflector plate in the lowered position as the rocker arm snaps back into an undepressed position. Thereafter, to raise the deflector plate to the upper position, which would be necessary, for instance, in order to access and clear the rifle's firing chamber, the first end of the rocker arm is manually depressed, which causes the catchment spur to pivot away from the deflector plate, thereby releasing the deflector plate to permit it to pivot upward to the upper position under the urging of a pivot spring.

In a second embodiment, the deflector is attachable to a carrying handle of a rifle, which handle has a rail mounting beam that extends longitudinally from a rear end to a front end thereof and a hand grasp that arcs above and joins said rear and front ends, thereby defining a handle opening. In this second embodiment, the deflector is in most respects similar to the first embodiment, but includes two, longitudinally spaced-apart screw clamp means connected to a base plate for attaching the deflector to the carrying handle. The second embodiment, like the first, includes a deflector plate, pivot means attached to the base plate for pivoting the deflector plate between an upper, ejector port uncovering position and a lower, ejector port covering position, and rocker arm catchment and release means attached to the base plate—all substantially identical to those of the first embodiment except insofar as the second embodiment of the deflector is dimensioned differently in order to accommodate the greater height that is required for the screw clamp means to overlie and grasp the rail mounting beam of the carrying handle.

BRIEF DESCRIPTION OF THE DRAWINGS

For a further understanding of the nature and objects of the present invention, reference should be had to the following description taken in conjunction with the accompanying drawings in which like parts are given like reference numerals and, wherein.

Figure 1:
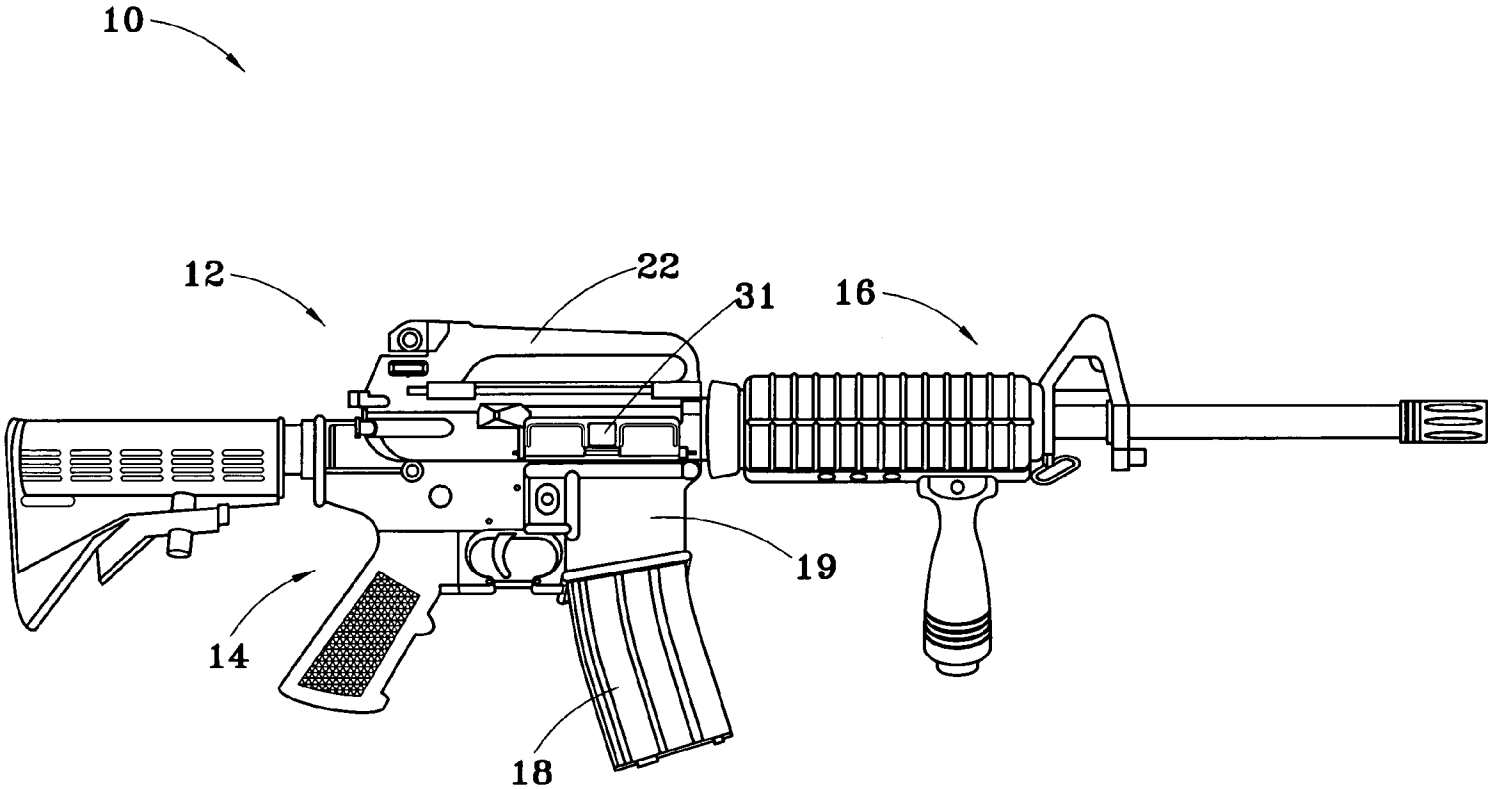
FIG. 1 (Prior Art)
FIG. 1 is a right side, elevational view of an M4 rifle with a carrying handle mounted on its upper receiver rail.
Figure 9:
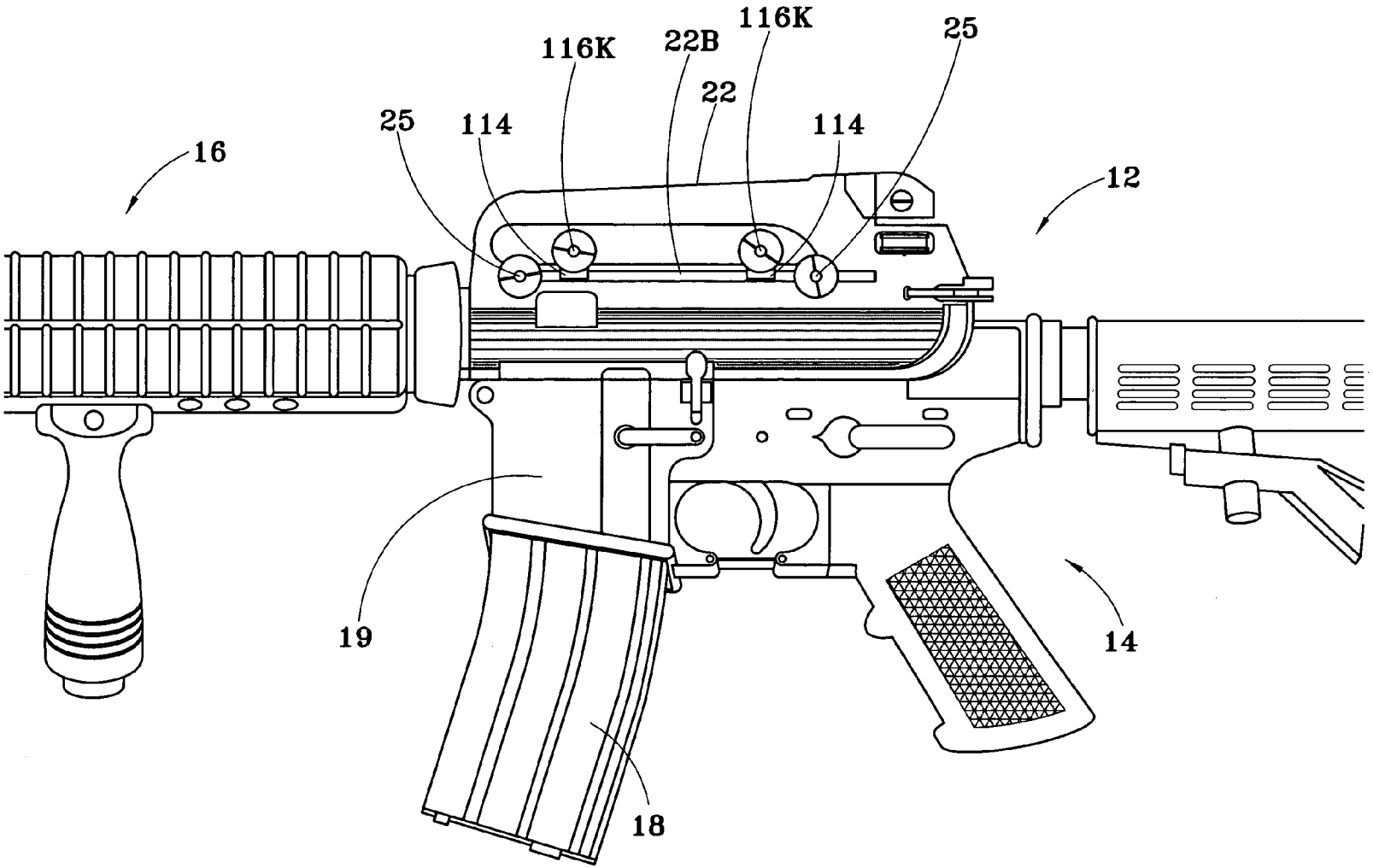
FIG. 9 is an enlarged, left side, elevational view thereof.

In the figures, the terms "rear" and "front" refer to the left side and right sides of FIG. 1 and the right and left sides of FIG. 9, respectively.

DETAILED DESCRIPTION OF THE PREFERRED EMBODIMENTS

Figure 2:
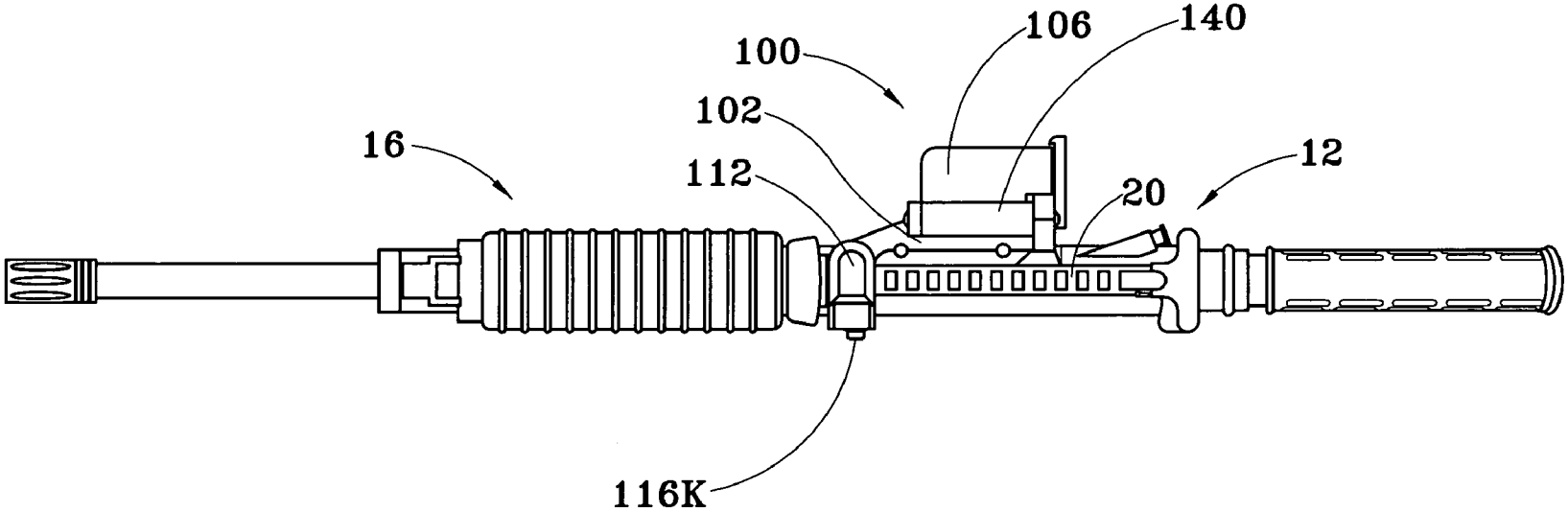
FIG. 2 is a top, plan view thereof with the carrying handle removed and a first embodiment of the invention installed on the upper receiver rail of the rifle and disposed in an extended position.
Figure 6:
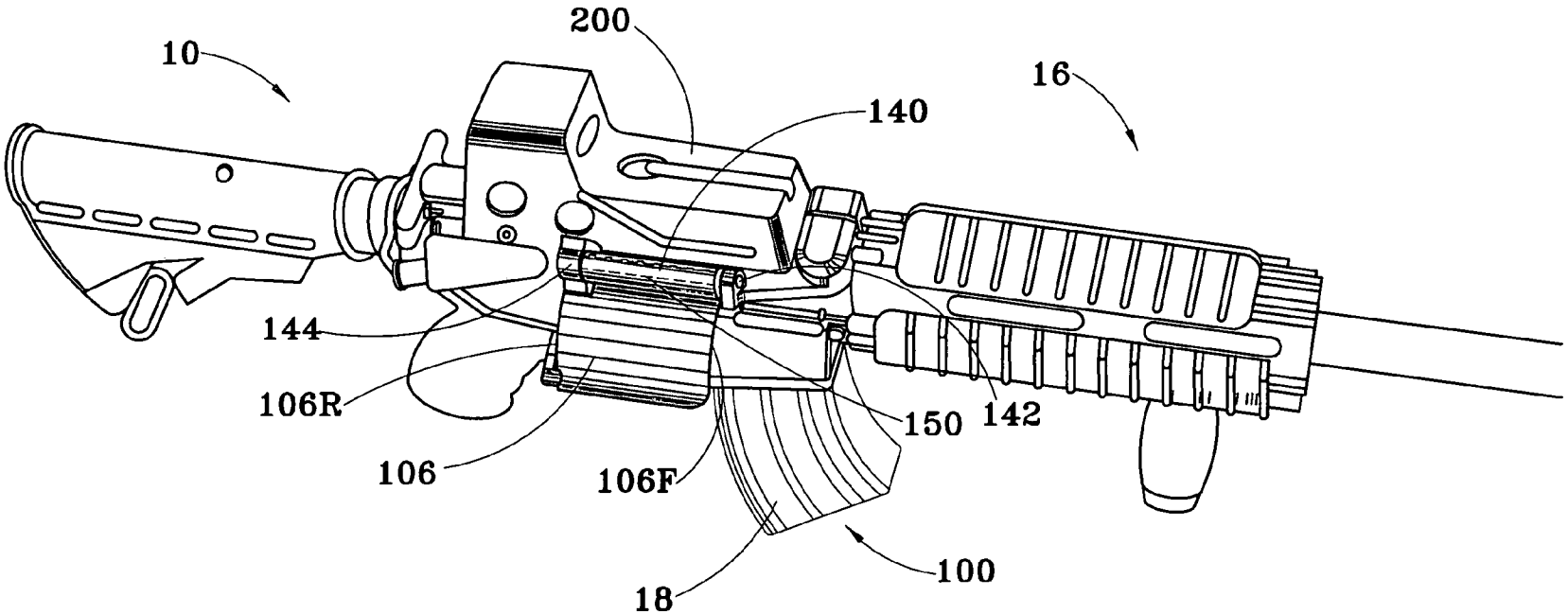
FIG. 6 is an upper, right side, perspective view of an M4 rifle from which the carrying handle has been removed, to which rifle is mounted both the first embodiment of the invention and a rifle monocular night vision device.
Figure 10:
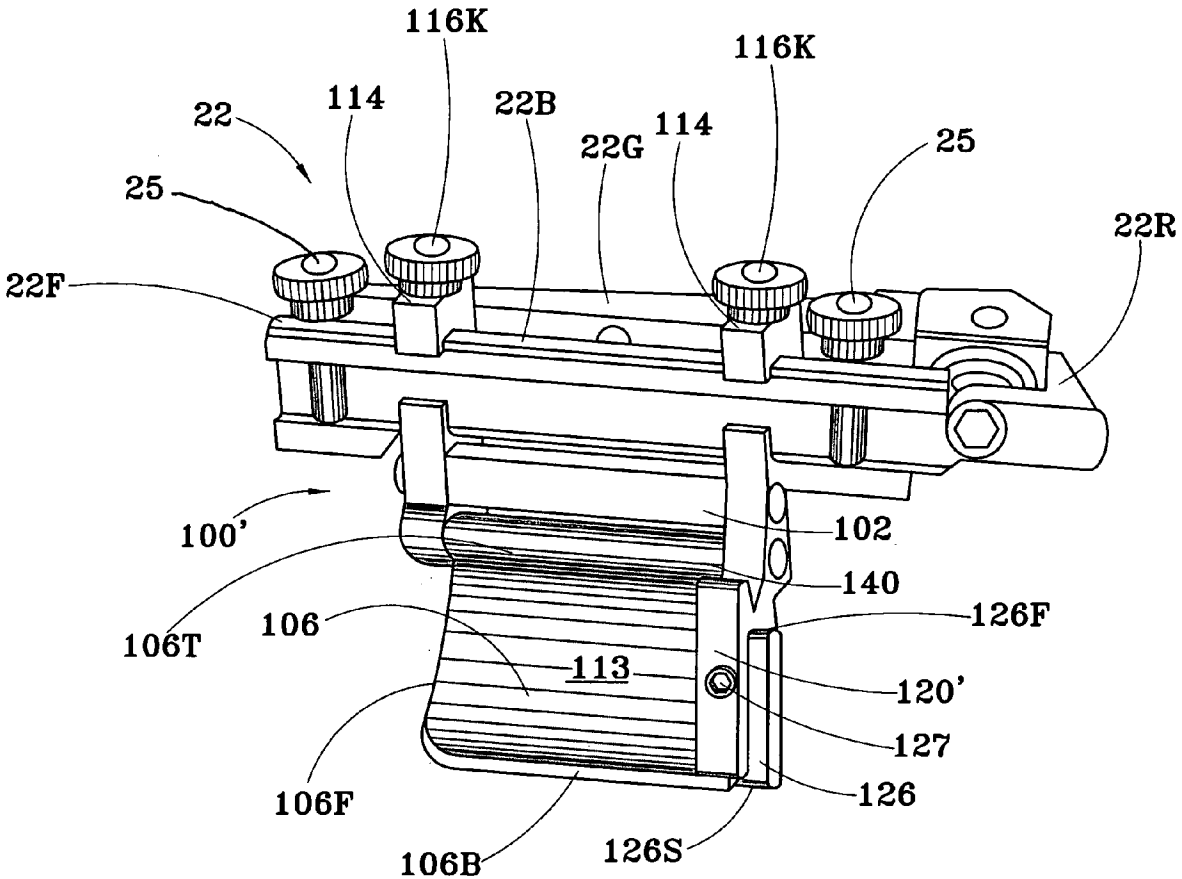
FIG. 10 is an enlarged, left side perspective view of the second embodiment of the invention, as viewed from below, attached to the carrying handle, which handle has been removed from the rifle.

In a first embodiment 100, the spent ammunition cartridge case deflector of the present invention can be adapted for use with a semiautomatic or automatic rifle 10, such as the M4 rifle depicted in FIGS. 1, 2, 3A, 3B. The rifle 10 is comprised of an upper receiver 12 that attaches to a lower receiver 14, a barrel assembly 16 that attaches to a front portion of the upper receiver, and an ammunition magazine 18 that inserts into a magazine well 19 of the lower receiver. Referring to FIG. 2, such rifles 100 have an upper receiver rail 20 to which a carrying handle 22 can alternately be attached and disattached by handle thumbscrews 24 that screw into internally-threaded openings in the rail; such thumbscrews 24 are best seen in FIG. 10. As shown in FIG. 6, a monocular night vision device 30 can also be mounted to the upper receiver rail 20, but only if the carrying handle 22 has first been removed from the rail. The first embodiment 100 of the deflector, therefore, is intended for use with a rifle 10 from which the carrying handle 22 has been removed and in conjunction with a monocular night vision device 30 or other device one might want to be able to attach to the upper receiver rail 20.

Figure 3A:
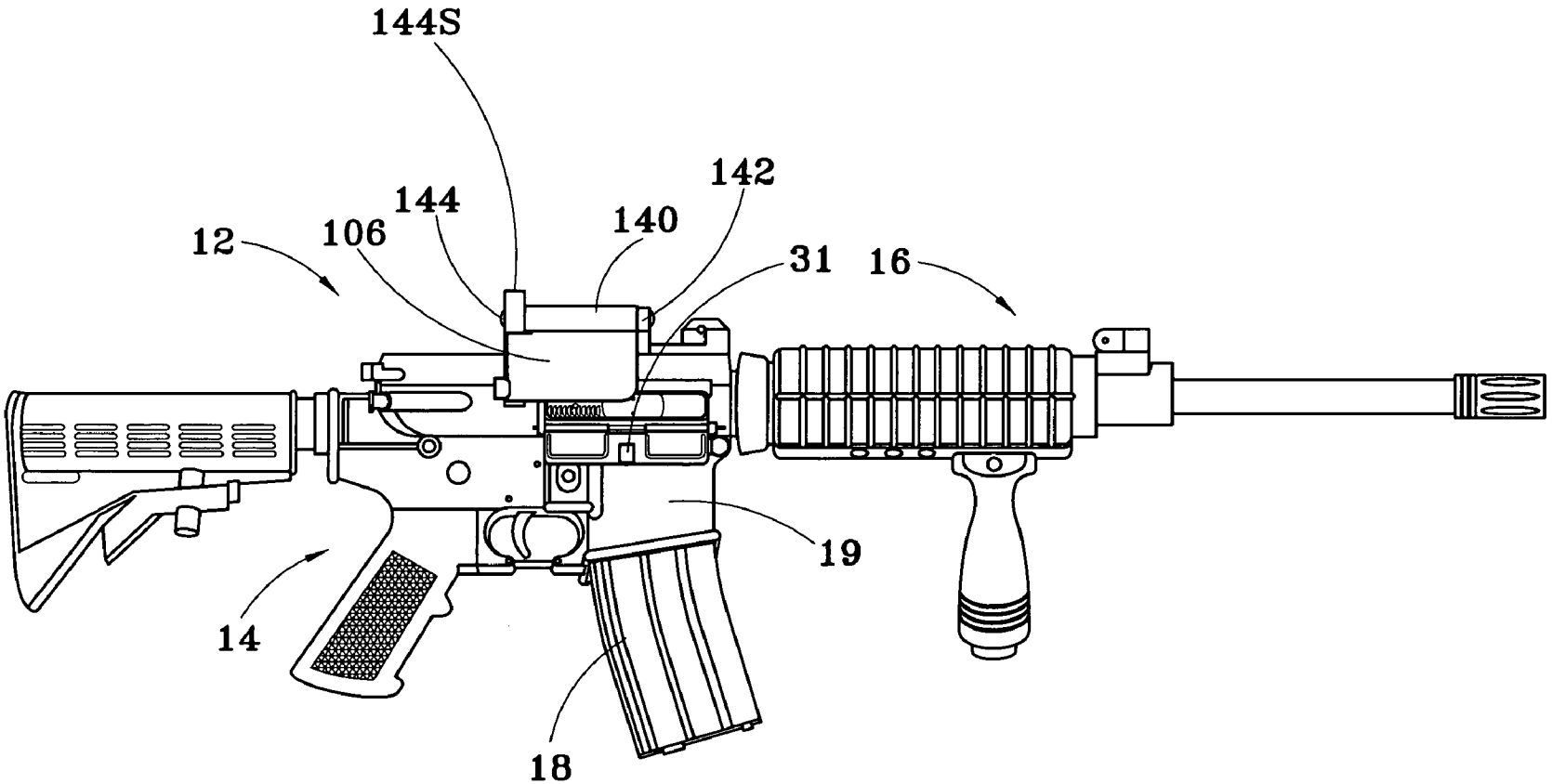
FIG. 3A is a right side, elevational view thereof.
Figure 3B:
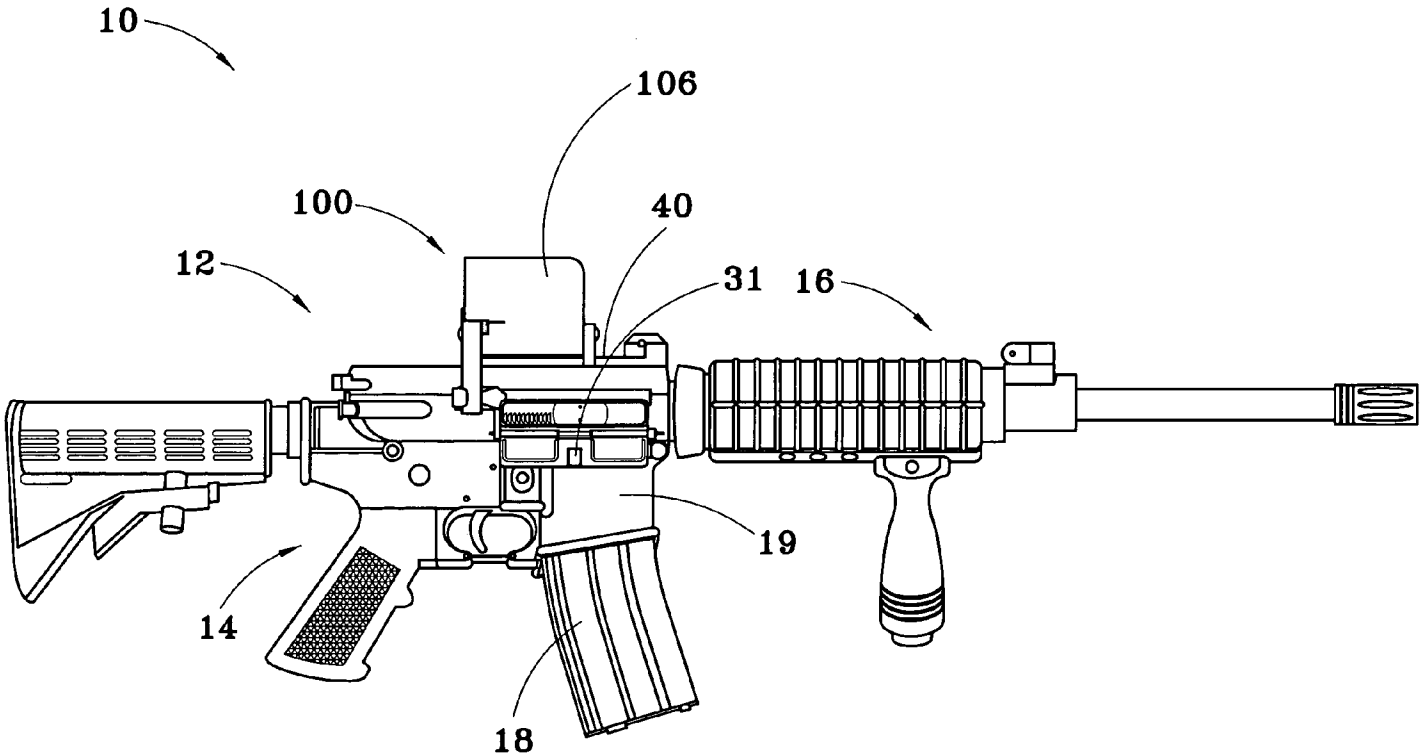
FIG. 3B is a right side, elevational view thereof, but with the first embodiment disposed in a retracted position.
Figure 4:
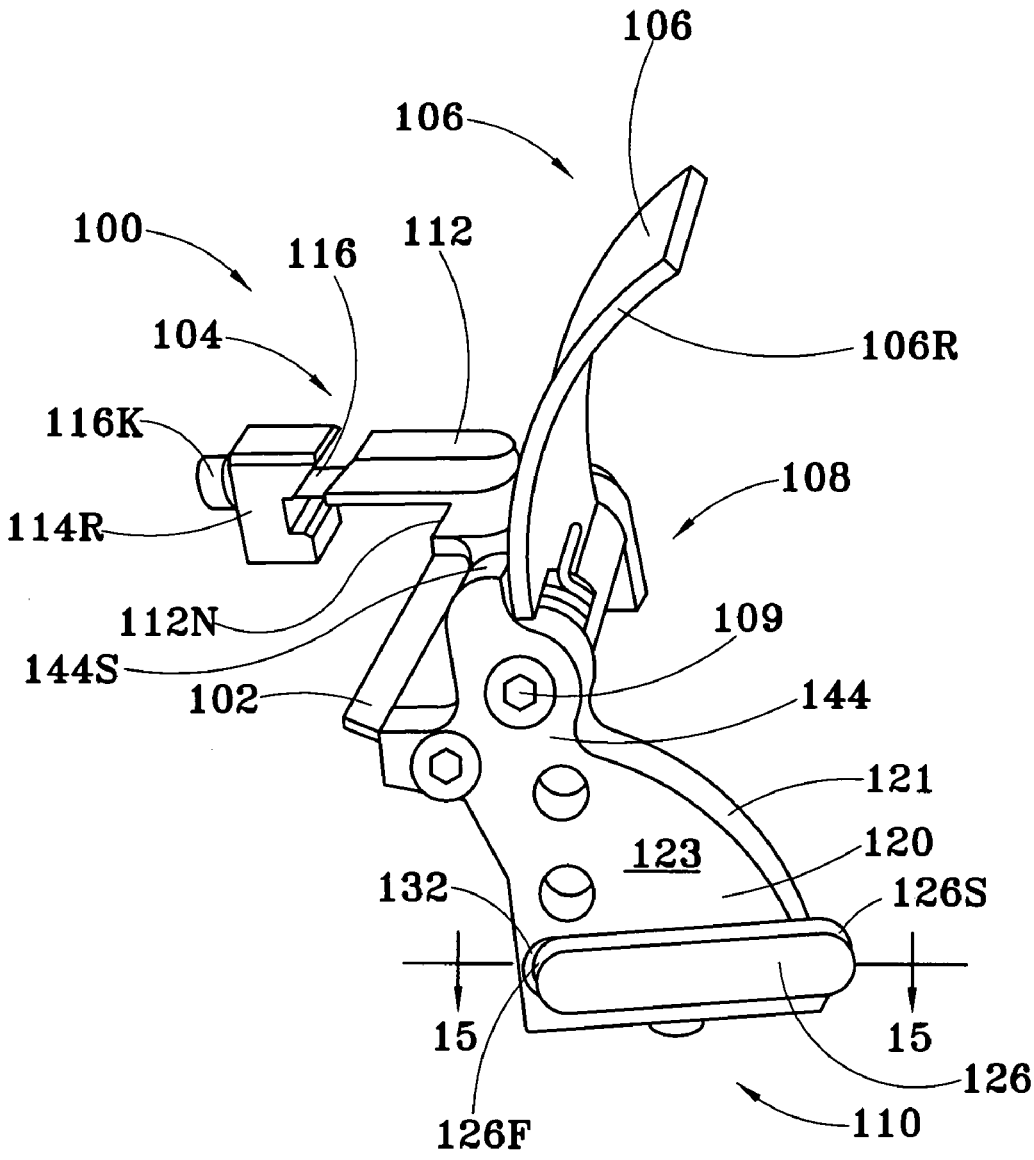
FIG. 4 is a rear, perspective view of the first embodiment of the invention, removed from the rifle and disposed in a retracted position.
Figure 5:
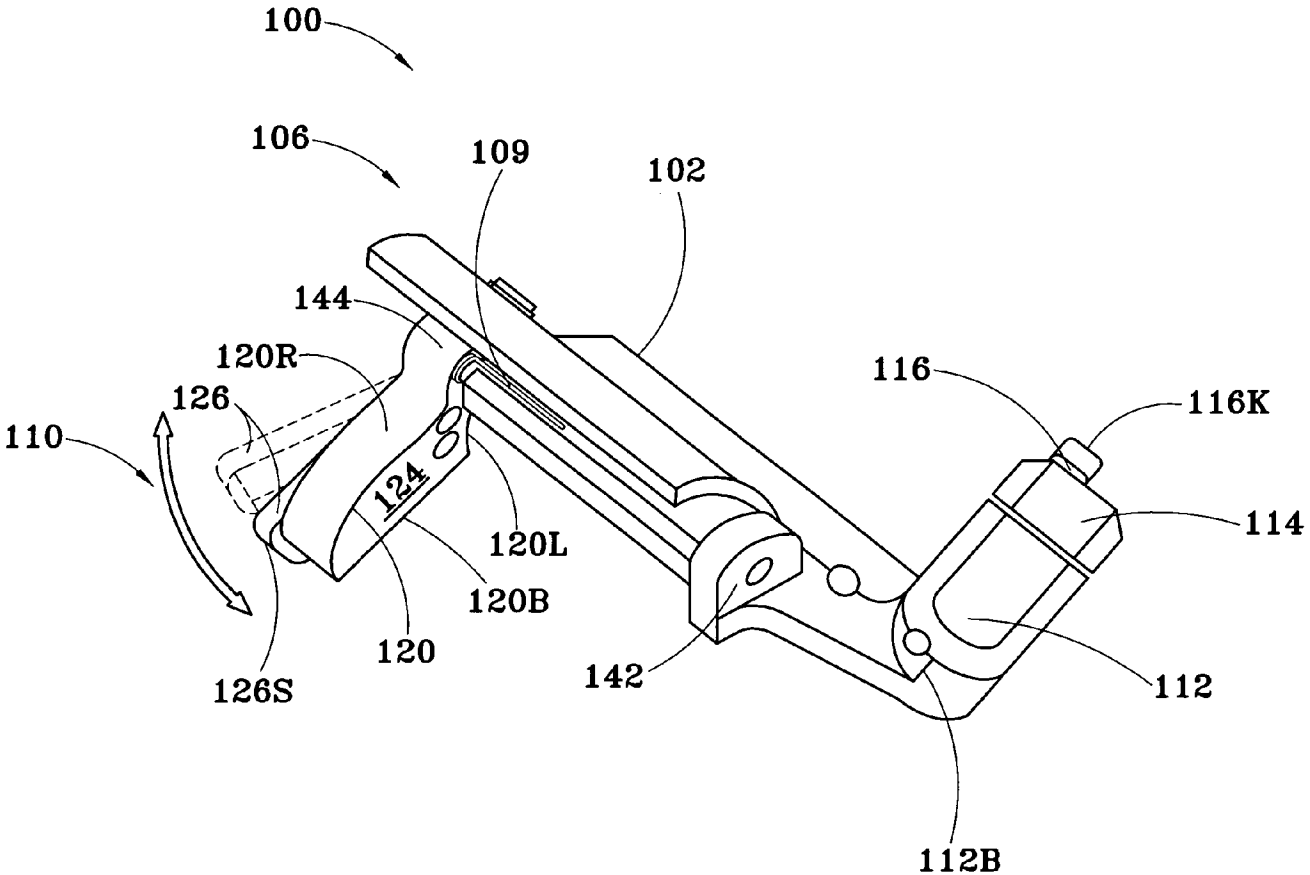
FIG. 5 is a top, perspective view thereof.

Referring to FIGS. 4 and 5, the first embodiment of the deflector 100 comprises a base plate 102 that extends longitudinally from a rear end to a front end; screw clamp means 104 attached to the base plate 102 for mounting the deflector to the upper receiver rail 20; a deflector plate 106; pivot means 108 attached to the base plate 102 for pivoting the deflector plate 106 between a lower, ejection port covering and spent cartridge case deflecting position and an upper, ejection port uncovering position; and rocker arm catchment and release means 110 attached to a rear end of the base plate 102 for manually and alternately locking the deflector plate 106 in the lowered position and releasing the deflector plate to pivot upward to the upper, retracted position. Preferably, the pivot means 108 includes a pivot spring 109 for urging the deflector plate 106 away from the lower position and toward the upper position. FIG. 3B depicts a right side elevational view of the first embodiment 100 of the deflector attached to a rifle 10, wherein the deflector plate 106 is disposed in a retracted position such that the deflector plate 106 does not cover ejection port 40. FIG. 3A depicts the deflector plate 106 disposed in a lower, ejection port covering position.

The screw clamp means 104 of the first embodiment 100 includes a transverse arm 112 that has a transverse, threaded bore 112B, a clamp jaw 114 having a transverse bore, and a clamp bolt 116 insertable through the bore of the clamp jaw and having mating threads for insertion and threaded engagement within the threaded bore of the transverse arm. At the place of joinder of the transverse arm 112 with the front end of the base plate 102 the transverse arm has a notch 112N; an apposing face of the clamp jaw 114 has a recess 114R. The notch 112N and the recess 114R are adapted to receive opposite side edges of the upper receiver rail 20 when the deflector 100 is mounted to the rail and tightened in place by rotation of the knurled knob end 116K of the clamp bolt 116.

Figure 15:
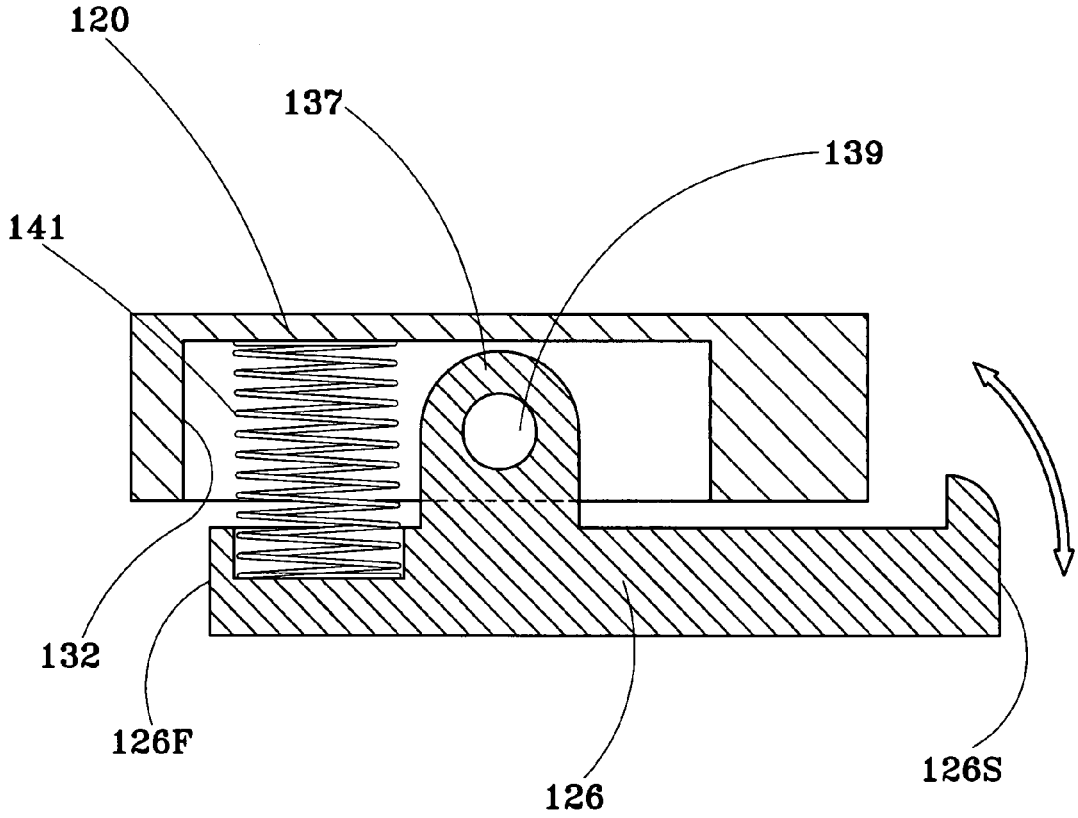
FIG. 15 is an enlarged, horizontal, cross-sectional view of the rear wall and of the rocker arm 126 of the first embodiment taken along line 15-15 of FIG. 4.

The rocker arm catchment and release means 110 includes a rear wall 120 that depends from the rear end of the base plate 102. Since the rocker arm catchment and release means 110 is identical in both the first embodiment 100 and the second embodiment 100' of the invention, reference may be had for this part of the description to FIGS. 12 and 13 as well as FIGS. 4 and 5. The rear wall 120 has a bottom edge 120B that joins a left edge 120L to a right edge 121, a rear surface 123 and an opposite front surface 124. A rocker arm 126 is mounted to the rear surface 123 of the rear wall 120 for pivotal rotation about a spring-loaded, rocker arm pivot pin 127 disposed within a recess 132 in the rear wall and upon an axis normal to the rocker arm. The rocker arm 126 extends transversely from a first end 126*f* to a second end 126*s* beyond the right edge 120R of the rear wall 120. Referring to FIG. 15, attached to the first end 126 is a rocker arm coil spring 141 that extends into the recess 132. A vertically-disposed rocker arm pivot shaft 139 mounted for rotation about a vertical axis within the recess 132 is attached to a projection 137 of the rocker arm 126 intermediate the first and second ends 126*f*, 126*s* thereof. Manual depression of the first end 126*f* forces said end into the recess 132, and simultaneously pivots the second end 126*s* away from the rear wall 120. Extending forward from a front surface of the second end 126*s* is a catchment spur that has a beveled, right edge forming a cam surface. As the deflector plate 106 is rotated downward from an upper, ejector port uncovered position to a lower, ejector port covering position, a rear edge 106R thereof engages the cam surface of the second end 126*s*, thereby pivoting the second end 126*s* at first away from the rear wall 120 (and the first end 126*f* into the recess 132) until the rear edge 106R slips past the cam surface, whereupon the rocker arm 126 snaps back to its original position such that the catchment spur traps the deflector plate 106 in the lower position. Thereafter, to release the deflector plate 106, the first end 126*f* is manually depressed into the recess 123, which pivots the catchment spur of the second end 126*s* away from the rear edge 106R of the deflector plate 106 and permits the pivot spring 109 to rotate the deflector plate to an upper position. With further reference to FIGS. and 3B, it may be seen that when the deflector plate 106 is disposed in a retracted position, a rifleman has manual access to an ejection cover plate 31 that is attached to the right side of the rifle 10 by a hinge adjacent to the ejection port. When the ejection cover plate 31 is flipped open, as shown in FIG. 3B, the rifleman can inspect and, if necessary, clear the firing chamber.

Figure 7:
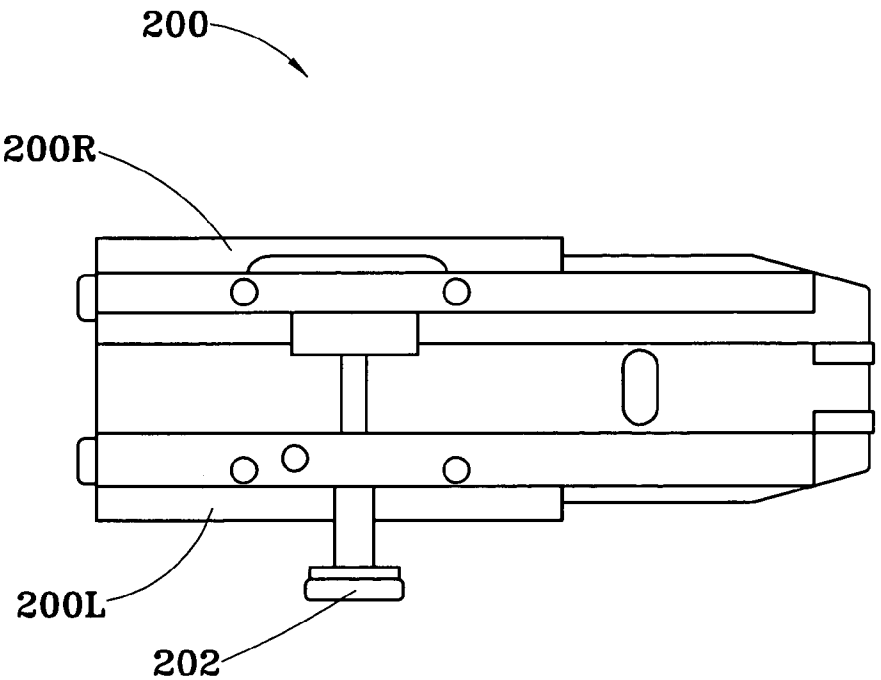
FIG. 7 (Prior Art)
FIG. 7 is a bottom, plan view of the monocular night vision device.

FIG. 6 depicts the deflector 100 attached to the upper receiver rail 20 of an M4 rifle 10 in conjunction with a monocular night vision device 200 that is also attached the rail, and wherein the deflector plate 106 is disposed in a lower, ejector port covering position. Forming an upper edge of the deflector plate 106 is a tubular hinge portion 140 that extends from a rear edge 106R to a front edge thereof. Front and rear apertured ear extensions 142, 144 of the base plate 102 are longitudinally spaced apart a distance just adequate to receive and straddle the hinge portion 140, and a pivot pin 150 (shown in phantom outline) is inserted through the apertured ears 142, 144 and the hinge portion 140. The pivot spring 109 has a first end attached to the rear ear 144 and a second, opposite end attached to the deflector plate 106. The right edge 121 of the rear wall 120 is convexly arcuate, comprising about a 45-degree sector of a circle, and the deflector plate 106 is similarly convexly arcuate as viewed from the right side of the rifle so that the rear edge 106R thereof fits snugly against the right edge 121 when lowered to the ejector port covering position. The rear ear 144 also includes an upstanding stop 144*s* to limit the upward travel of the deflector plate 106, as may be seen in FIG. 4. The rear edge 106R of the deflector plate 106 near its tubular hinge portion 140 is cut away to accommodate the rear ear 144. Attachment of the deflector 100 to the rail 20 leaves the rail sufficiently unobstructed to permit attachment of the monocular night vision device 200 to the rail. FIG. 7 depicts a bottom plan view of the monocular night vision device 200, which has right and left channels 200L, 200R to receive the left and rights sides of the upper receiver rail 20 and a screw bolt 202 for securing the sight to the rail.

Figure 8A:
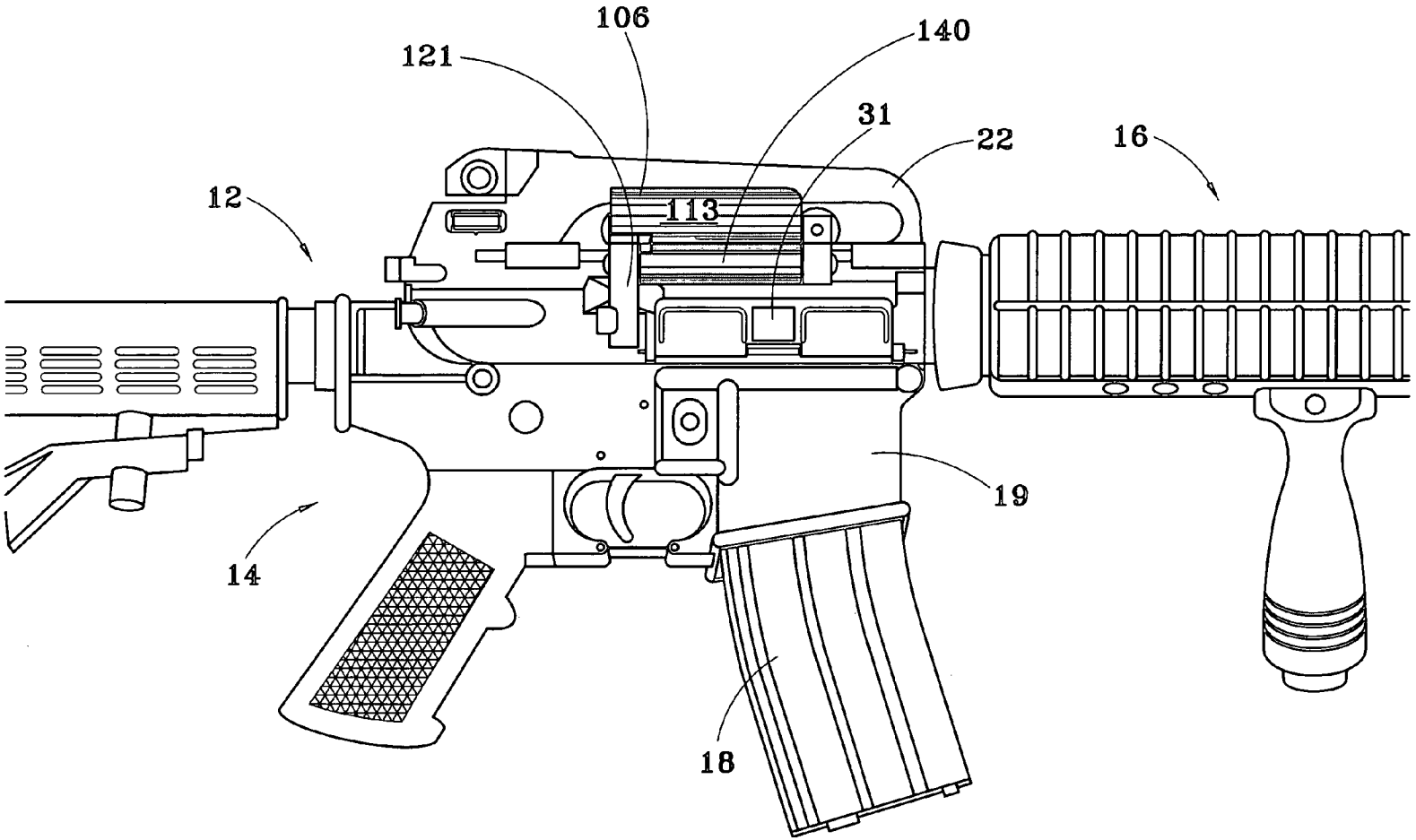
FIG. 8A is an enlarged, right side, elevational view of an M4 rifle to the upper receiver rail of which are mounted a carrying handle and a second embodiment of the invention, disposed in an upper, retracted position.
Figure 8B:
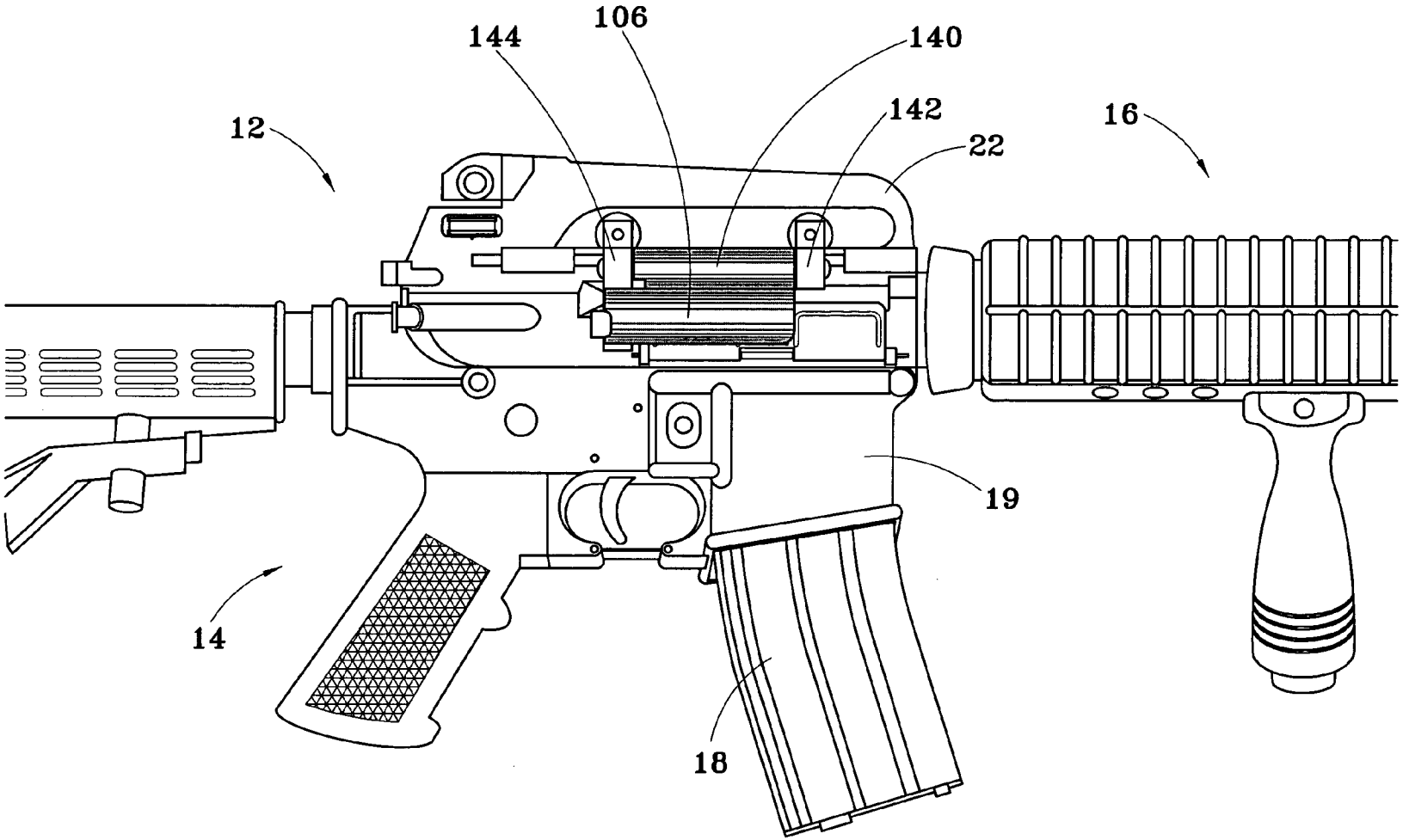
FIG. 8B is an enlarged, right side, elevational view thereof, but with the second embodiment disposed in a lower, extended position.
Figure 11:
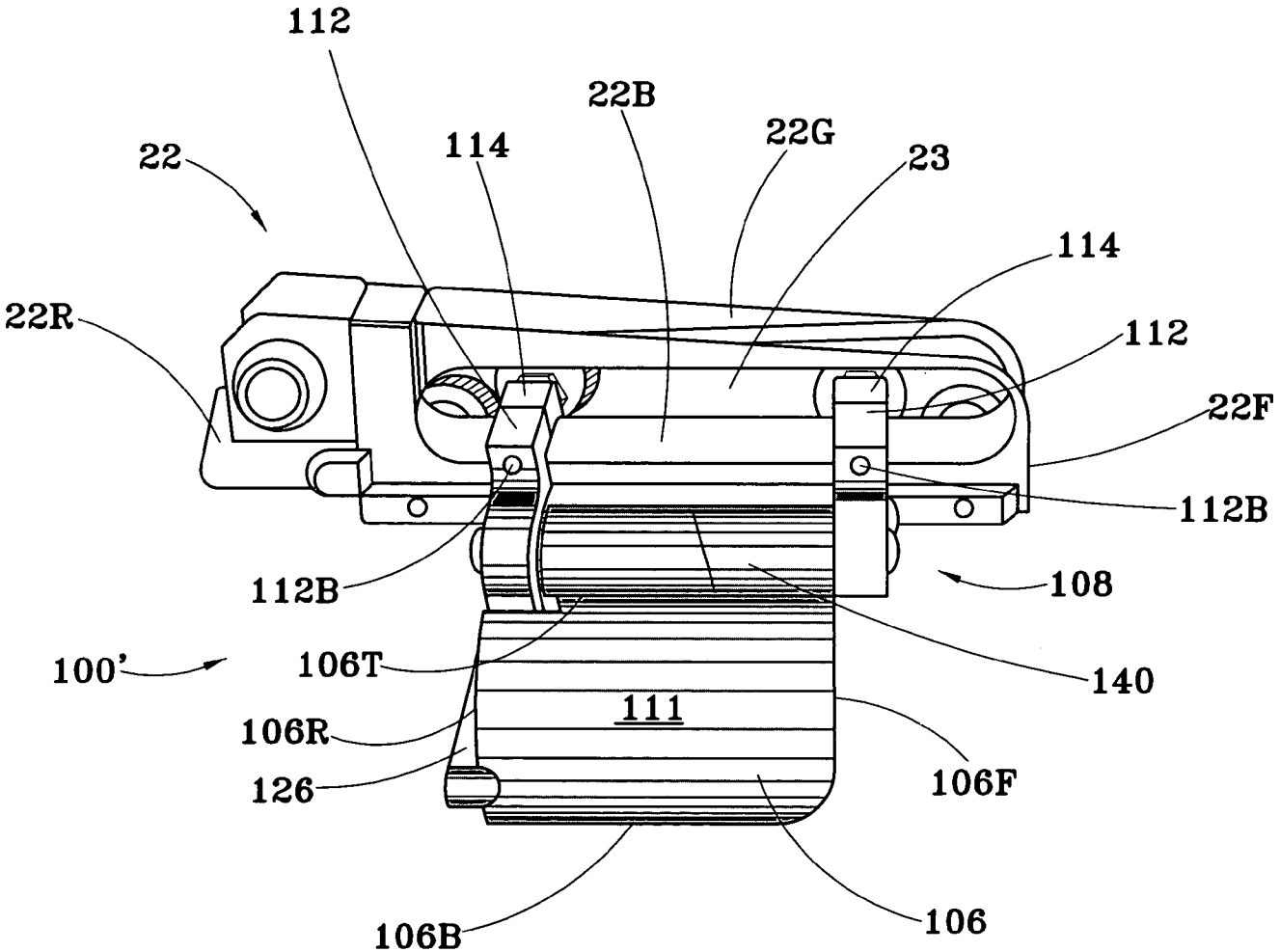
FIG. 11 is a right side, perspective view thereof.
Figure 12:
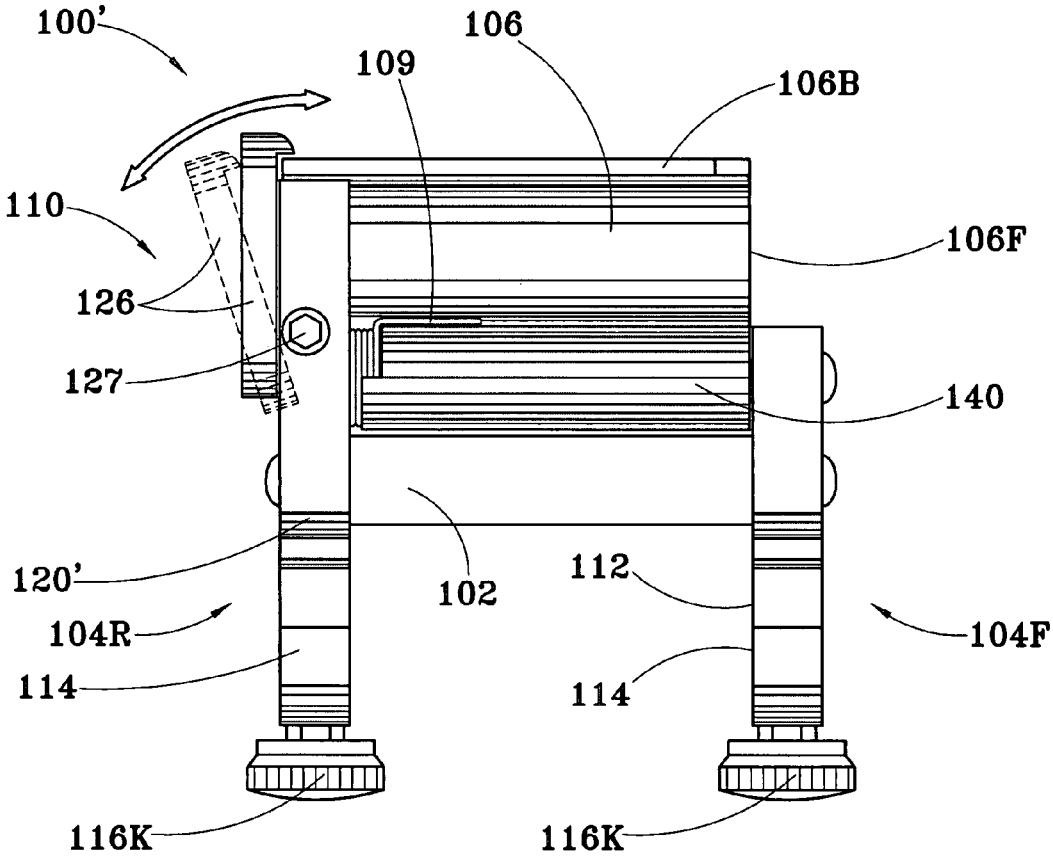
FIG. 12 is a bottom view of the second embodiment of the invention detached from the carrying handle with the deflector plate disposed in a lower, extended position.
Figure 13:
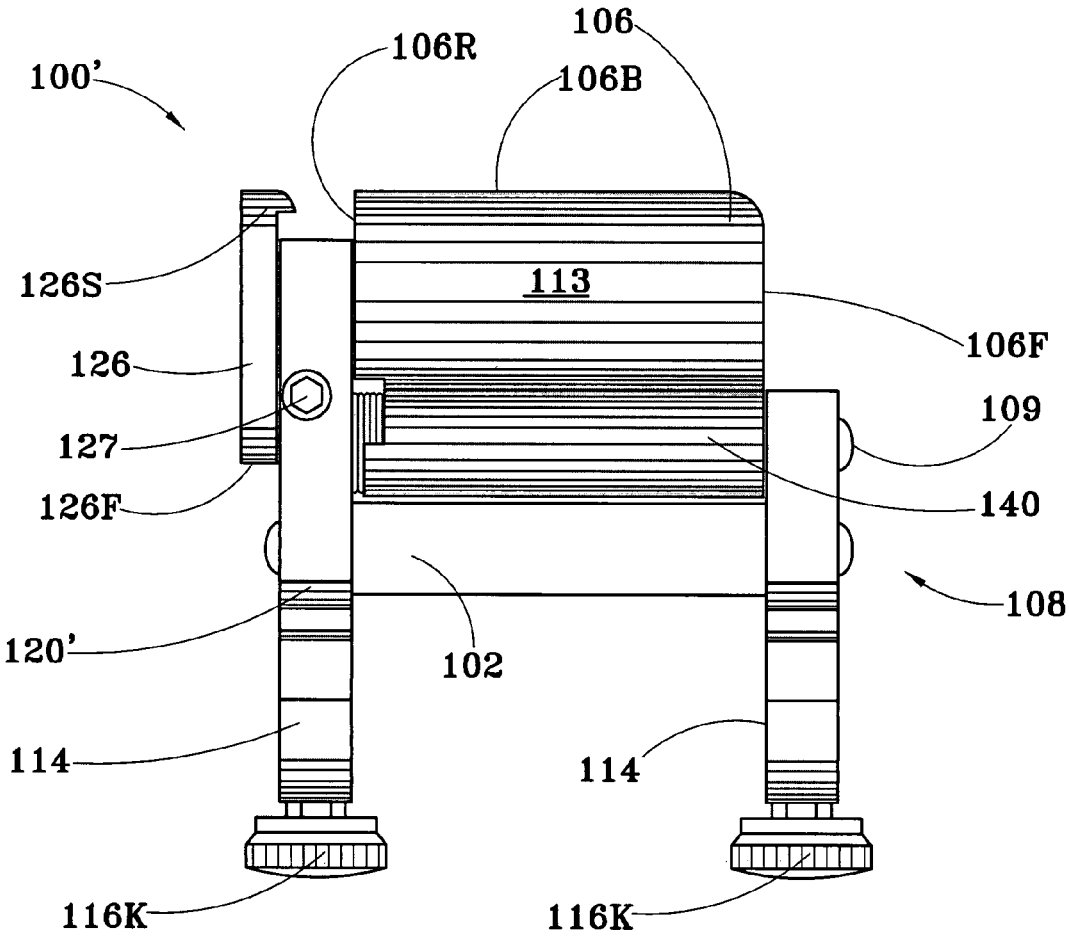
FIG. 13 is a bottom view thereof with the deflector plate disposed in an upper, retracted position.

When it is desired to maintain the carrying handle 22 mounted to the upper receiver rail 20, a second embodiment 100' of the deflector may be used. The second embodiment 100' differs from the first embodiment 100 primarily in the following ways: it has two, longitudinally spaced-apart screw clamp means 104R, 104F for attachment to the carrying handle 22 instead of just a single screw clamp means 104 for attachment to the upper receiver rail 20; and the left wall 120' is somewhat larger and has a different shape compared to the left wall 120 of the first embodiment 100. Referring to FIGS. 10-12, it may be seen that the carrying handle 22 includes a rail mounting beam 22B that extends longitudinally from a rear end 22R to a front end 22F and a hand grasp 22G that arcs above and joins said rear and front ends, thereby defining a handle opening 23. The carrying handle 22 further includes a pair of longitudinally-spaced thumb screws 25 for attaching the handle to the upper receiver rail 20. As may be seen in FIGS. 10-13, the second embodiment of the deflector 100' is comprised of a base plate 102 that extends longitudinally from a rear end to a front end; rear and front screw clamp means 104R, 104F attached to the rear and front ends of the base plate, respectively; a deflector plate 106 that has right and left side surfaces 111, 113, bounded by rear and front edges 106R, 106F joined by top and bottom edges 106T, 106B; spring-based pivot means 108 attached to the base plate 102'; and rocker arm catchment and release means 110 attached to a rear end of the base plate 102'. As in the first embodiment 100, the right edge 121 of the rear wall 104' is convexly arcuate, extending through about a 45 degree sector of a circle, as may be seen in FIG. 8A, and the deflector plate 106 has a matching convexly arcuate contour. The rocker arm catchment and release means 110 for the second embodiment 100' is substantially identical to that of the first embodiment 100 and requires no further discussion.

Figure 14:
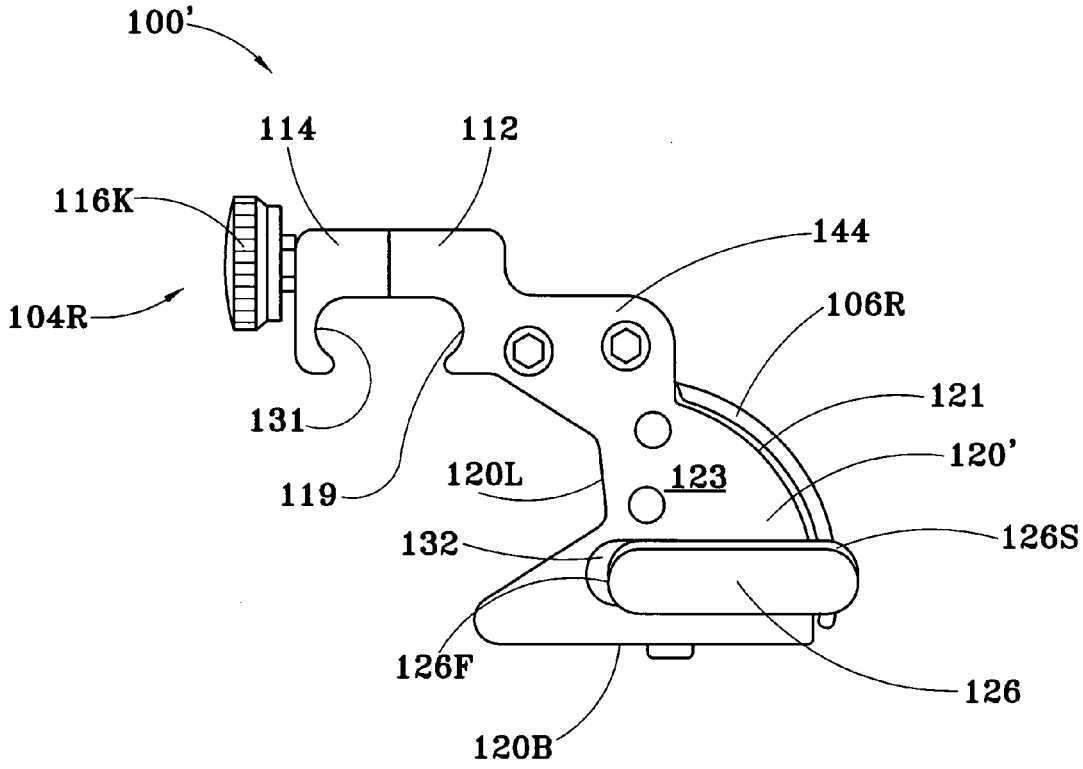
FIG. 14 is a rear, elevational view of the second embodiment of the invention.

Each screw clamp means 104R, 104F of the second embodiment 100' is adapted for overlying, clamping engagement with the rail mounting beam 22B of the carrying handle. Each screw clamp means 104R, 104F includes a transverse arm 112 having a transverse, threaded bore 112B, a clamp jaw 114 having a transverse bore 112B, and a clamp bolt 116 insertable through the bore of the clamp jaw. Each clamp bolt 116 has a knurled knob 116K. As may be seen in FIG. 14, the rear transverse arm 104R is a leftward extension from an upper portion of the rear wall 104'. The lower edge 119 of each the transverse arms 112 as well as the lower edge 131 of each of the clamp jaws 114 are cut away and contoured to receive and engage the upper receiver rail 20. As in the first embodiment 100', the second embodiment includes an apertured rear ear 144 integral with the rear wall 120' and an apertured front ear 142 that extends from the base plate 102, longitudinally spaced-apart for a distance just adequate to receive and straddle the hinge portion 140 of the deflector plate 106, and a pivot pin 150 inserted through the apertured ears 142, 144 and the hinge portion 140.

From the foregoing description it will be clear that the present invention may be embodied in other specific forms without departing from the sprit or essential characteristics thereof. Thus, the presently disclosed embodiments are to be considered in all respects as illustrative and not restrictive, the scope of the invention being indicated by the appended claims, and not limited to the foregoing description. In particular, the invention is not restricted for use with an M4 rifle, for it is within the ability of persons of ordinary skill in these arts to adapt the herein disclosed invention for use with a variety of types of semiautomatic and automatic rifles.

I claim:

1. A spent ammunition cartridge case deflector that is attachable to an upper receiver rail of a rifle, said rail extending longitudinally from a rear end to a front end, said rifle having a spent ammunition cartridge case ejector port disposed below said rail and on the right side of the rifle, comprising:

a base plate that extends longitudinally from a rear end to a front end;

screw clamp means attached to the base plate for mounting the deflector to said receiver rail;

a deflector plate for downward deflection of spent ammunition cartridge cases as they are ejected out of the ejector port when the rifle is being fired, said plate having left and right side surfaces bounded by rear and front edges joined by top and bottom edges;

pivot means attached to the base plate, whereby the deflector plate is pivotably attached to the base plate for movement between a lower, ejection port covering and spent cartridge case deflecting position and an upper, ejection port uncovering position, said means including a pivot spring for urging the deflector plate away from the lower position and toward the upper position; and rocker arm catchment and release means attached to the base plate for manually and alternately locking the deflector plate in the lowered position and releasing the deflector plate to pivot upward to the upper position.

2. The deflector of claim 1, wherein the screw clamp means includes a transverse arm having a transverse, threaded bore, a clamp jaw having a transverse bore, and a clamp bolt insertable through the bore of the clamp jaw, said bolt having mating threads for insertion and threaded engagement within the threaded bore of the transverse arm.

3. The deflector of claim 2, wherein the clamp bolt has a knurled knob.

4. The deflector of claim 3, wherein the transverse arm is attached to the front end of the base plate.

5. The deflector of any one of claims 1-4, wherein the rocker arm catchment and release means includes a rear wall that depends from the rear end of the base plate, which wall has a bottom edge that joins a left edge to a right edge thereof, a rear surface and an opposite front surface, said rear surface having a rocker arm recess;

a rocker arm pivotally attached to the rear surface of the rear wall adjacent to the rocker arm recess for pivotal rotation about a rocker arm pivot pin, said rocker arm extending transversely from a first end to a second end beyond the right edge of the rear wall, said second end including a catchment spur, and said catchment spur having a cam surface;

wherein the left edge of the deflector plate aligns with the right edge of the rear wall when the deflector plate is in the lowered position; and said means further includes a rocker arm spring disposed within the rocker arm recess for urging the return of the first end of the rocker arm to an undepressed position;

whereby, pivoting the deflector plate downward from the upper position causes the rear edge of the deflector plate to engage the cam surface of the catchment spur, thereby pivoting the first end of the rocker arm into the rocker arm recess and permitting the rear edge of the deflector plate to engage the right edge of the rear wall, which action locks the deflector plate in the lowered position, whereupon the rocker arm spring returns the rocker arm to an undepressed condition and, whereby further, when the deflector plate is in the lowered and locked position, depression of the first end of the rocker arm into the rocker arm recess causes the catchment spur to be pivoted away from the deflector plate, thereby releasing the deflector plate to pivot upward to the upper position under the urging of the pivot spring.

6. The deflector of claim 5, wherein a top edge of the deflector plate has a tubular hinge portion that extends from the rear edge to the front edge thereof, and the pivot means includes an apertured, rear ear extension of the rear wall;

an apertured, front ear extension of the base plate that is spaced apart from the rear ear extension a distance just adequate to receive and straddle said tubular hinge portion;

a pivot pin inserted through the apertures of the rear and front ear extensions and through said tubular hinge portion; and wherein the pivot spring has a first end attached to the left wall and a second end attached to the deflector plate.

7. The deflector of claim 6, wherein the top edge of the deflector plate is cut away at a rear end thereof to accommodate the rear ear extension.

8. The deflector of claim 7, wherein the rear wall further includes a stop for limiting upward, pivoting movement of the deflector plate.

9. The deflector of claim 8, wherein the deflector plate, except the tubular hinge portion thereof, is concave, and the right edge of the rear wall is contoured to match said concave surface in mating engagement.

10. The deflector of claim 9, wherein the rifle is a member of the M4 rifle series.

11. A spent ammunition cartridge case deflector that is attachable to a carrying handle of a rifle, said rifle having an upper receiver rail and a spent ammunition cartridge case ejector port disposed below said rail and on the right side of the rifle, said handle including a rail mounting beam that extends longitudinally from a rear end to a front end thereof and a hand grasp that arcs above and joins said rear and front ends, thereby defining a handle opening, comprising:

a base plate that extends longitudinally from a rear end to a front end;

rear and front screw clamp means attached to the rear and front ends of the base plate, respectively, for mounting the deflector to the carrying handle;

a deflector plate for downward deflection of spent ammunition cartridge cases as they are ejected out of the ejector port when the rifle is being fired, said plate having left and right side surfaces bounded by rear and front edges joined by top and bottom edges;

pivot means attached to the base plate, whereby the deflector plate is pivotably attached to the base plate for movement between a lower, ejection port covering and spent cartridge case deflecting position and an upper, ejection port uncovering position, said means including a pivot spring for urging the deflector plate away from the lower position and toward the upper position; and rocker arm catchment and release means attached to the base plate for manually and alternately locking the deflector in the lowered position and releasing the deflector plate to pivot upward to the upper position.

12. The deflector of claim 11, wherein each screw clamp means is adapted for overlying, clamping engagement with the rail mounting beam of the carrying handle, and includes a transverse arm having a transverse, threaded bore, a clamp jaw having a transverse bore, and a clamp bolt insertable through the bore of the clamp jaw, said bolt having mating threads for insertion and threaded engagement within the threaded bore of the transverse arm.

13. The deflector of claim 12, wherein each clamp bolt has a knurled knob.

14. The deflector of claim 13, wherein the transverse arm of the rear screw clamp is attached to the rear end of the base plate and the transverse arm of the front screw clamp is attached to the front end of the base plate.

15. The deflector of any one of claims 11-14, wherein the rocker arm catchment and release means includes a rear wall that depends from the rear end of the base plate, which wall has a bottom edge that joins a left edge to a right edge thereof, a rear surface and an opposite front surface, said rear surface having a rocker arm recess;

a rocker arm pivotally attached to the rear surface of the rear wall adjacent to the rocker arm recess for pivotal rotation about a rocker arm pivot pin, said rocker arm extending transversely from a first end to a second end beyond the right edge of the rear wall, said second end including a catchment spur, said catchment spur having a cam surface;

wherein the deflector plate aligns with the rear edge of the deflector plate closely engages the right edge of the rear wall when the deflector plate is in the lowered position; and said means further includes a rocker arm spring disposed within said recess for urging the return of the first end of the rocker arm to an undepressed position; whereby, pivoting the deflector plate downward from the upper position causes the rear edge of the deflector plate to engage the cam surface of the catchment spur, thereby pivoting the first end of the rocker arm into the recess and permitting the left side of the deflector plate to engage the right edge of the rear wall, which action locks the deflector plate in the lowered position, whereupon the rocker arm spring returns the rocker arm to an undepressed condition and, whereby further, when the deflector plate is in the lowered and locked position, depression of the first end of the rocker arm into the rocker arm recess causes the catchment spur to be pivoted away from the deflector plate, thereby releasing the deflector plate to pivot upward to the upper position under the urging of the pivot spring.

16. The deflector of claim 15, wherein a top edge of the deflector plate has a tubular hinge portion that extends from the rear edge to the front edge thereof, and the pivot means includes an apertured, rear ear extension of the rear wall;

an apertured, front ear extension of the base plate that is spaced apart from the rear ear extension a distance just adequate to receive and straddle said tubular hinge portion;

a pivot pin inserted through the apertures of the rear and front ears and through said tubular hinge portion; and wherein the pivot spring has a first end attached to the rear wall and a second end attached to the deflector plate.

17. The deflector of claim 16, wherein the upper edge portion of the deflector plate is cut away at a rear end thereof to accommodate the rear ear extension of the rear wall.

18. The deflector of claim 17, wherein the deflector plate, except the tubular hinge portion thereof, is concave, and the right edge of the rear wall is contoured to match said concave deflector plate in mating engagement.

19. The deflector of claim 18, wherein the rifle is a member of the M4 rifle series.

* * * * *